US011087916B2

(12) United States Patent
Cho et al.

(10) Patent No.: US 11,087,916 B2
(45) Date of Patent: Aug. 10, 2021

(54) INDUCTOR AND METHOD OF MANUFACTURING THE SAME

(71) Applicant: SAMSUNG ELECTRO-MECHANICS CO., LTD., Suwon-Si (KR)

(72) Inventors: Seok Young Cho, Suwon-Si (KR); Youn Soo Seo, Suwon-Si (KR)

(73) Assignee: SAMSUNG ELECTRO-MECHANICS CO., LTD., Gyeonggi-do (KR)

( * ) Notice: Subject to any disclaimer, the term of this patent is extended or adjusted under 35 U.S.C. 154(b) by 322 days.

(21) Appl. No.: 16/117,945

(22) Filed: Aug. 30, 2018

(65) Prior Publication Data

US 2019/0295763 A1 Sep. 26, 2019

(30) Foreign Application Priority Data

Mar. 20, 2018 (KR) ..... 10-2018-0032185

(51) Int. Cl.

| | |
|---|---|
| ***H01F 27/29*** | (2006.01) |
| ***H01F 27/28*** | (2006.01) |
| ***H01F 41/04*** | (2006.01) |
| ***H01F 41/12*** | (2006.01) |
| ***H01F 27/32*** | (2006.01) |

(52) U.S. Cl.

CPC ..... *H01F 27/2804* (2013.01); *H01F 27/29* (2013.01); *H01F 27/323* (2013.01); *H01F 41/041* (2013.01); *H01F 41/122* (2013.01); *H01F 2027/2809* (2013.01)

(58) Field of Classification Search

CPC .... H01F 27/2804; H01F 27/29; H01F 41/041; H01F 41/122; H01F 27/323; H01F 2027/2809; H01F 2017/048; H01F 17/0013; H01F 41/046; H01F 27/292; H01F 37/00; H01F 27/28; H01F 41/00

See application file for complete search history.

(56) References Cited

U.S. PATENT DOCUMENTS

| | | | | |
|---|---|---|---|---|
| 3,848,210 A * | 11/1974 | Felkner | H01F 17/04 336/200 |
| 6,600,404 B1 * | 7/2003 | Kajino | H01F 5/003 257/531 |
| 2016/0276094 A1 * | 9/2016 | Lee | H01F 27/324 |
| 2017/0287621 A1 * | 10/2017 | Seino | H01F 1/28 |

FOREIGN PATENT DOCUMENTS

| | | |
|---|---|---|
| JP | H11-204337 A | 7/1999 |
| JP | 2007-273836 A | 10/2007 |
| KR | 101792388 B1 | 11/2017 |

* cited by examiner

*Primary Examiner* — Tuyen T Nguyen

(74) *Attorney, Agent, or Firm* — Morgan, Lewis & Bockius LLP

(57) ABSTRACT

An inductor includes a body including a support member containing a through-hole, a coil disposed on the support member, and a magnetic material sealing the support member and the coil, and an external electrode disposed on an external surface of the body. The coil includes an upper coil and a lower coil disposed on an upper surface and a lower surface of the support member, respectively, and the upper coil and the lower coil are connected to each other by a connection pattern. The connection pattern surrounds at least portions of the upper coil and the lower coil and contacts a wall surface of the through-hole.

20 Claims, 9 Drawing Sheets

INDUCTOR AND METHOD OF MANUFACTURING THE SAME

CROSS-REFERENCE TO RELATED APPLICATION(S)

This application claims benefit of priority to Korean Patent Application No. 10-2018-0032185 filed on Mar. 20, 2018 in the Korean Intellectual Property Office, the disclosure of which is incorporated herein by reference in its entirety.

TECHNICAL FIELD

The present disclosure relates to an inductor and a method of manufacturing the same, and more particularly, to a thin film power inductor for high capacity implementation and a method of manufacturing the same.

BACKGROUND

As the functions of mobile devices have been diversified and power consumption has increased, passive components have been required to have high efficiency with less loss and to be employed around power management integrated circuits (PMICs), to increase the battery usage time of mobile devices. Of these, low profile inductors having excellent efficiency while being miniaturized, to increase battery capacity, are required.

SUMMARY

An aspect of the present disclosure is to provide an inductor having improved Rdc characteristics by increasing a thickness of a coil within a low profile chip size, and a method of manufacturing the same.

According to an aspect of the present disclosure, an inductor includes a body including a support member containing a through-hole, a coil disposed on the support member, and a magnetic material sealing the support member and the coil, and an external electrode disposed on an external surface of the body. The coil includes an upper coil and a lower coil disposed on an upper surface and a lower surface of the support member, respectively, and the upper coil and the lower coil are connected to each other by a connection pattern. The connection pattern surrounds at least portions of the upper coil and the lower coil and contacts a wall surface of the through-hole.

The connection pattern may extend along a portion of the wall surface of the through-hole, and the connection pattern and an innermost coil pattern of the coil may form a right angle.

The upper coil and the lower coil may each include a plurality of pattern layers.

Only a portion of an upper surface of one coil pattern of the upper coil, directly contacting the connection pattern, may be covered by the connection pattern, and only a portion of an upper surface of one coil pattern of the lower coil, directly contacting the connection pattern, may be covered by the connection pattern.

A thickness of the support member may be within a range of 5 μm to 40 μm.

The connection pattern may include a conductive material.

An outer boundary surface of the support member may have a shape corresponding to a shape of an outer boundary surface of the coil.

The support member may not include a penetration portion other than the through-hole, the penetration portion penetrating through the upper surface and the lower surface of the support member.

The inductor may further include an insulating layer extending continuously to cover the connection pattern and the coil.

The insulating layer may be in physical contact with the connection pattern.

In a thickness direction along which the upper and lower surfaces of the support member oppose each other, a thickness of the connection pattern may be greater than a thickness of the support member.

According to an aspect of the present disclosure, a method of manufacturing an inductor includes preparing a support member, forming an upper coil and a lower coil including a plurality of pattern layers on upper and lower surfaces of the support member, forming a through-hole penetrating through upper and lower surfaces of the support member, forming a connection pattern on at least a portion of a wall surface of the through-hole to connect the upper coil and the lower coil to each other, insulating a surface of the coil, forming a body by filling a space including the through-hole of the support member with a magnetic material, and forming an external electrode on the body.

The method of manufacturing an inductor may further include preparing a substrate having a thickness greater than a thickness of the support member, prior to the preparing of the support member, to form the upper coil and the lower coil.

The method of manufacturing an inductor may further include detaching the upper coil and the lower coil from the substrate, after forming the upper coil and the lower coil on the substrate.

The method of manufacturing an inductor may further include disposing a dry film, except for a space in which the connection pattern is formed, in the forming of the connection pattern.

The connection pattern may extend along the portion of the wall surface of the through-hole, and the connection pattern and innermost coil patterns of the upper coil and the lower coil may be perpendicular with each other.

The forming of the through-hole may be initially performed by forming a hole penetrating through the upper and lower surfaces of the support member.

The forming of the upper coil and the lower coil may be performed by a combination of isotropic plating and anisotropic plating.

A lowermost pattern layer, among the plurality of pattern layers, in the upper coil and the lower coil may be formed by chemical copper plating.

According to an aspect of the present disclosure, an inductor include a body including a support member containing a through-hole, a coil disposed on the support member, and an encapsulant encapsulating the support member and the coil; and an external electrode disposed on an external surface of the body. The coil includes an upper coil and a lower coil disposed on an upper surface and a lower surface of the support member, respectively, the upper coil and the lower coil being connected to each other by a connection pattern disposed in the through-hole. In a thickness direction along which the upper and lower surfaces of the support member oppose each other, a thickness of the connection pattern is greater than a thickness of the support member.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
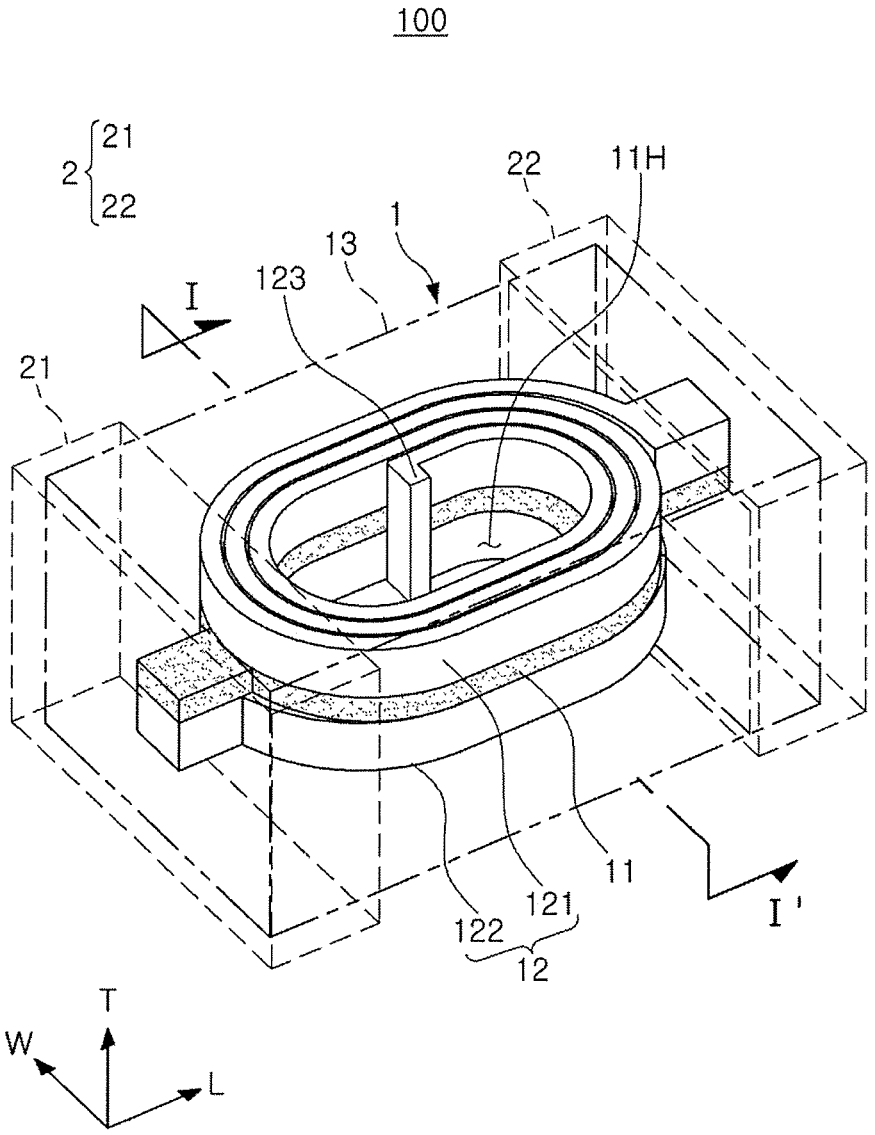
FIG. 1 is a schematic perspective view of an inductor according to an exemplary embodiment in the present disclosure.

Hereinafter, embodiments of the present disclosure will be described with reference to the accompanying drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element, or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be construed as being limited by these terms. These terms are only used to distinguish one member, component, region, layer or section from another region, layer or section. Thus, a first member, component, region, layer or section discussed below could be termed a second member, component, region, layer or section without departing from the teachings of the embodiments.

Spatially relative terms, such as "above," "upper," "below," "lower" and the like, may be used herein for ease of description to describe one element's relationship to another element (s), as shown in the figures. It will be understood that spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both upward and downward orientations, depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

Hereinafter, an inductor and a method of manufacturing the same, according to an exemplary embodiment, will be described, but an exemplary embodiment thereof is not limited thereto.

Inductor

Figure 2:
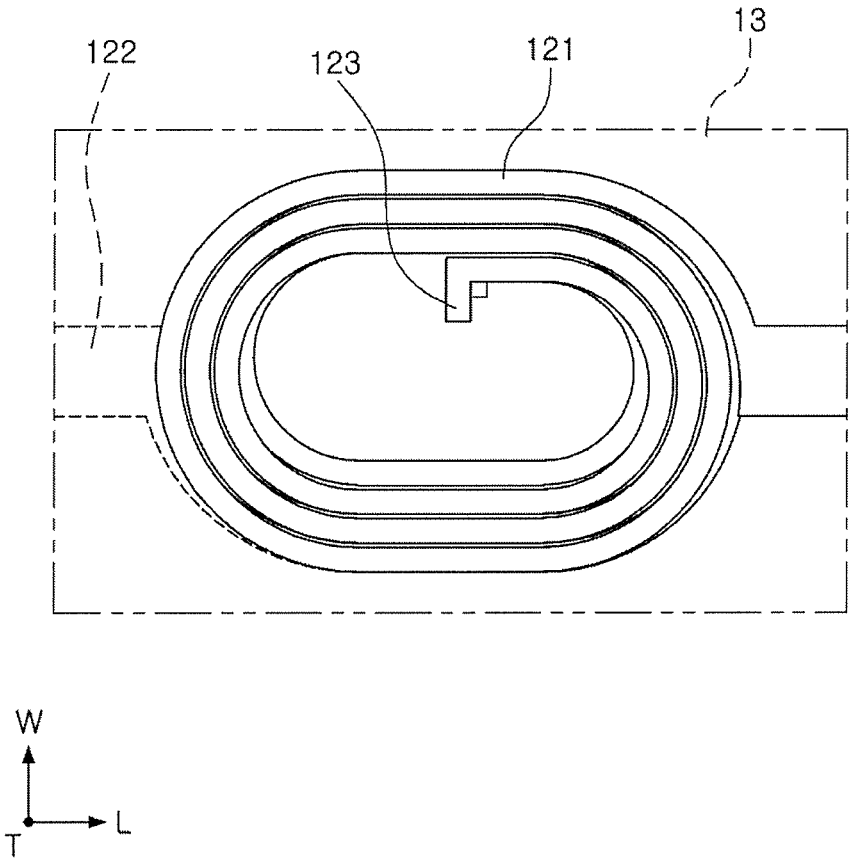
FIG. 2 is a plan view of the inductor of FIG. 1 when viewed from above.
Figure 3:
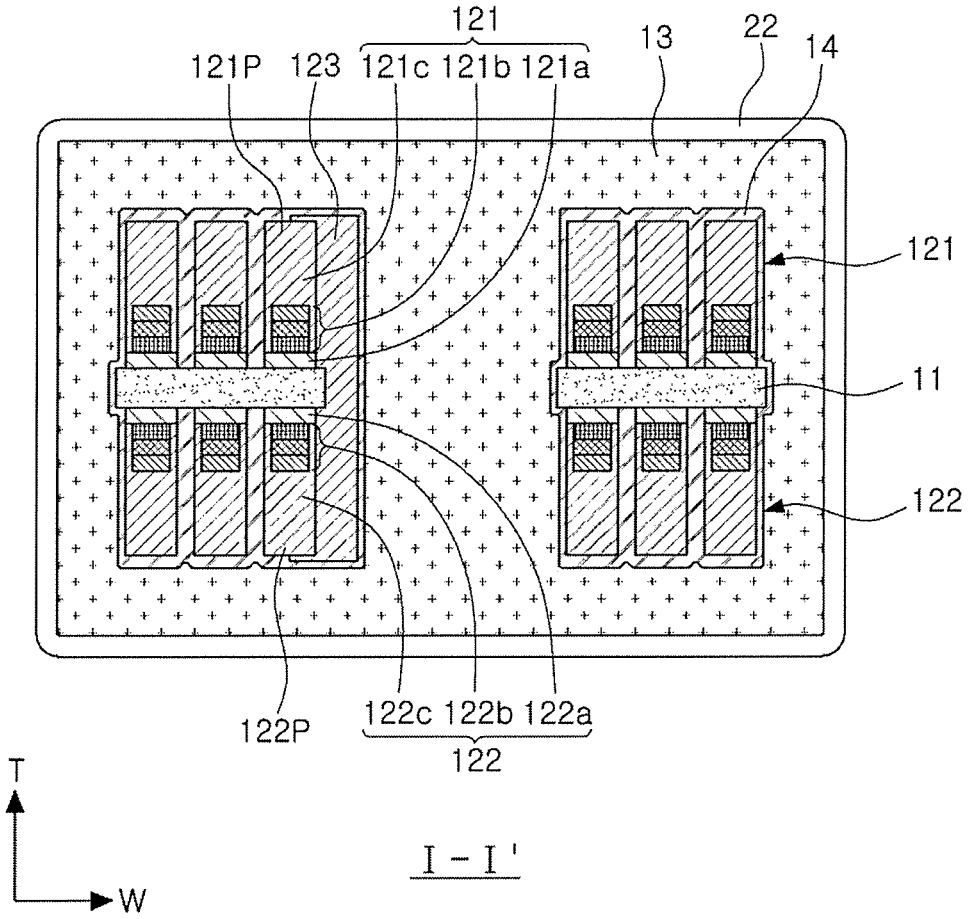
FIG. 3 is a cross-sectional view of the inductor taken along line I-I' of FIG. 1.

FIG. 1 is a schematic perspective view of an inductor according to an exemplary embodiment, FIG. 2 is a plan view of FIG. 1 viewed from above, and FIG. 3 is a cross-sectional view taken along line I-I' of FIG. 1.

Referring to FIGS. 1 to 3, an inductor 100 according to an exemplary embodiment may include a body 1 and an external electrode 2.

The body 1 may determine an external appearance of the inductor. The body 1 may include upper and lower surfaces opposing each other in a thickness direction T, first and second end surfaces opposing each other in a length direction L, and first and second side surfaces opposing each other in a width direction W, thereby forming a substantially hexahedral shape.

The external electrode 2 may be disposed on an outer surface of the body, and may be electrically connected to a coil formed in the body 1. The external electrode 2 may include first and second external electrodes 21 and 22 having different polarities. FIG. 1 illustrates that the first and second external electrodes 21 and 22 are configured to be spaced apart from each other in the length direction of the body and to each have a C shape, but an exemplary embodiment thereof is not limited thereto.

The body 1 may include a support member 11, a coil 12 supported by the support member, and a magnetic material 13 sealing the support member 11 and the coil 12.

As a material of the support member 11, any material may be used without limitation, as long as it is capable of insulating upper and lower coils, and for example, a thermosetting resin such as an epoxy resin, a thermoplastic resin such as polyimide, or a resin obtained by impregnating the thermosetting resin or the thermoplastic resin with a reinforcing material such as a glass fiber or an inorganic filler, for example, a prepreg, may be used. In addition, although a copper clad laminate (CCL) known in the art may be used as the support member, an Ajinomoto Build up Film (ABF), a photoimagable dielectric (PID) resin or the like known in the art, capable of satisfying a thickness of 5 μm to 40 μm, may be used to meet the requirements of low profile. The support member 11 may have a thickness of 5 μm or more, such that the support member 11 may have sufficient rigidity to support the coil 12 and to facilitate handling thereof, and may have a thickness of 40 μm or less, to appropriately meet the requirements for low profile.

The support member 11 may have a predetermined thickness, may have a thin plate shape including an upper surface and a lower surface, and may include a through-hole 11H penetrating through the upper surface and the lower surface. A cross-sectional shape of the through-hole 11H is not particularly limited, and may be, for example, an elliptical shape, a circular shape, or a quadrilateral shape with curved corners. At least a portion of a wall surface of the through-hole 11H may be surrounded by a connection pattern electrically connecting an upper coil and a lower coil. The connection pattern will be described in detail together with descriptions of the coil.

The coil 12 may be supported by the support member 11, and the coil 12 may include an upper coil 121 disposed on an upper surface of the support member 11 and a lower coil 122 disposed on a lower surface of the support member 11. The upper and lower coils 121 and 122 may be electrically connected to each other by a connection pattern 123.

An outer boundary surface of the support member 11 may have a shape corresponding to an outer boundary surface of the coil 12. In this case, a flow of magnetic flux may be relatively smooth in the entirety of a magnetic flux region, and magnetic permeability may be improved.

Each of the upper and lower coils 121 and 122 may include a plurality of pattern layers. Since the description of the upper coil 121 may be applied to the lower coil as it is, the upper coil 121 will only be described in detail for convenience of explanation.

The upper coil 121 may have a substantially spiral shape, and the plurality of pattern layers may be isotropic plating layers or anisotropic plating layers. In this case, the isotropic plating layer may be a plating layer in which a plating growth rate in a thickness direction and a plating growth rate in width and length directions are constant with respect to each other, and the anisotropic plating layer may be a plating layer in which a plating growth rate in width and length directions is lower than a plating growth rate in a thickness direction. The plurality of pattern layers may have a boundary line for each plating layer, which refers to separate processes in which respective pattern layers are formed and a plating process has been performed a plurality of times. In this case, the combination of the isotropic plating layer and the anisotropic plating layer and the sequence thereof may be appropriately selected as required.

The plurality of pattern layers constituting the upper coil 121 may include first to third pattern layers 121*a*, 121*b* and 121*c*, which may be appropriately selected according to a design environment and as required. The third pattern layer 121*c* may be a pattern layer that substantially determines a thickness of the coil, and in detail, may be an anisotropic plating layer.

As an example, the first pattern layer 121*a* may be formed by patterning a previously prepared copper foil layer, and the second pattern layer 121*b* may be a plating layer formed by using the first pattern layer 121*a* as a seed layer. Similarly, the third pattern layer 121*c* may be a plating layer formed by using the second pattern layer 121*b* as a seed layer. The second pattern layer 121*b* disposed on the first pattern layer 121*a* may be embedded in the third pattern layer 121*c*. In this case, side surfaces and an upper surface of the second pattern layer 121*b* may be covered by the third pattern layer 121*c*.

The connection pattern 123 may be required to connect the upper coil 121 to the lower coil 122 formed on the lower surface of the support member 11. In the case of an inductor according to the related art, in order to electrically connect upper and lower coils to each other, a separate via hole should be provided in addition to a through-hole penetrating through the support member, and the via hole should be filled with a conductive material. However, in the case of an inductor according to an exemplary embodiment in the present disclosure, the upper and lower coils 121 and 122 may be electrically connected to each other using the through-hole 11H, without providing a separate via hole, and the inductor may include the connection pattern 123 formed on at least a portion of the wall surface of the through-hole 11H. As a result, a process of forming a separate via hole may be omitted, thereby increasing process efficiency and reducing possibility of occurrence of plating deviation.

As illustrated in FIG. 3, a side cross section of the connection pattern 123, a W-T cross section of the body, may have a C shape. However, the cross-sectional shape of the connection pattern 123 is not limited thereto, and any structure capable of connecting the upper coil 121 and the lower coil 122 may be employed without limitation. For example, when the connection pattern connects at least a portion of the upper coil and at least a portion of the lower coil to each other, at least a portion of an upper surface of one coil pattern 121*p* of the upper coil 121 connected to the connection pattern 123 may not be covered by the connection pattern 123. Similarly, at least a portion of an upper surface of one coil pattern 122*p* of the lower coil 122 connected to the connection pattern 123 may not be covered by the connection pattern 123. The connection pattern 123 may also be formed to cover the entirety of the upper surfaces of the coil patterns 121*p* and 122*p*. In a case in which the connection pattern is formed to cover the entirety of the upper surfaces of the coil patterns, the upper and lower coils may be stably connected. However, in this case, since a thickness of the connection pattern 123 may be relatively high, the extent to which the upper surfaces of the coil patterns 121*p* and 122*p* should be covered may be determined in consideration of required specifications.

On the other hand, as illustrated in FIG. 2, when the upper and lower coils 121 and 122 are connected to each other using the connection pattern 123, a right angle between the connection pattern and an innermost coil pattern thereof may be formed. In this case, electrical characteristics of inductors may be relatively excellent, which is from the reason that a filling amount of a magnetic material filling the inside of the through-hole may be significantly when a direction in which the connection pattern extends and a direction in which the innermost coil pattern extends are perpendicular to each other.

The coil 12 and the support member 11 may be filled by a magnetic material 13, in a state in which a surface of the coil is coated with an insulating layer 14 to obtain insulation between the magnetic material and the coil. The insulating layer 14 may also be configured to cover a wall surface of the through-hole 11H or to selectively cover only the surface of the coil 12, depending on a formation method of the insulating layer 14.

As the magnetic material 13, any material may be used as long as it has magnetic properties, and for example, ferrite or a metal-based soft magnetic material may be filled and used. Examples of the ferrite may include Mn—Zn-based ferrite, Ni—Zn-based ferrite, Ni—Zn—Cu-based ferrite, Mn—Mg-based ferrite, Ba-based ferrite, Li-based ferrite, or the like, known in the art. The metal-based soft magnetic material may be an alloy including one or more selected from the group consisting of iron (Fe), silicon (Si), chromium (Cr), aluminum (Al) and nickel (Ni), and for example, may include Fe—Si—B—Cr based amorphous metal particles, but is not limited thereto. Particles of the metal-based soft magnetic material may have a particle diameter within a range of 0.1 μm to 20 μm, and may be distributed in a polymer such as an epoxy resin, polyimide or the like.

The magnetic material may fill an inside of the through-hole 11H of the support member 11 to increase permeability. In this case, as a thickness of the connection pattern 123, in contact with an interface thereof while surrounding a portion of the wall surface of the through-hole 11H, is reduced, it may be advantages that a filling rate of the magnetic material in the vicinity of the through-hole 11H may be further increased. In this case, the thickness of the connection pattern 123 may only be configured to an extent to which the upper and lower coils may be stably connected to each other.

Figure 4A:
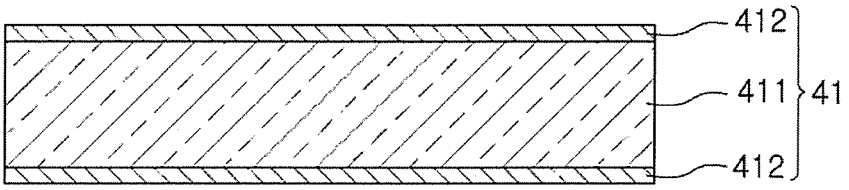
FIGS. 4A to 4N are process drawings of a method of manufacturing an inductor according to an exemplary embodiment in the present disclosure.
Figure 4B:
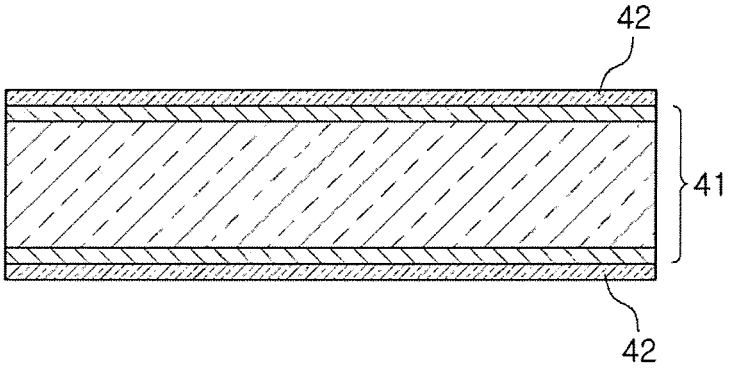
Figure 4C:
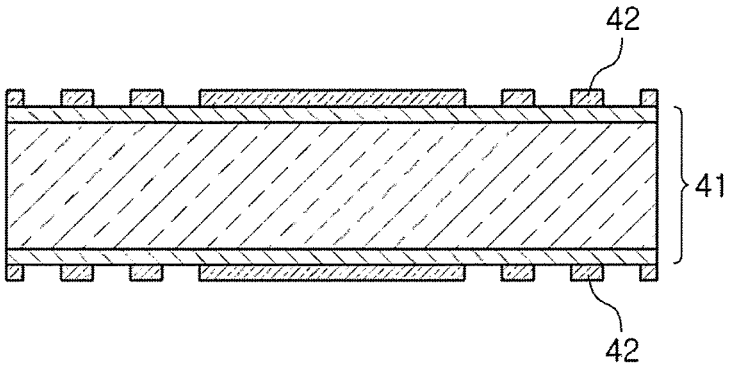
Figure 4D:
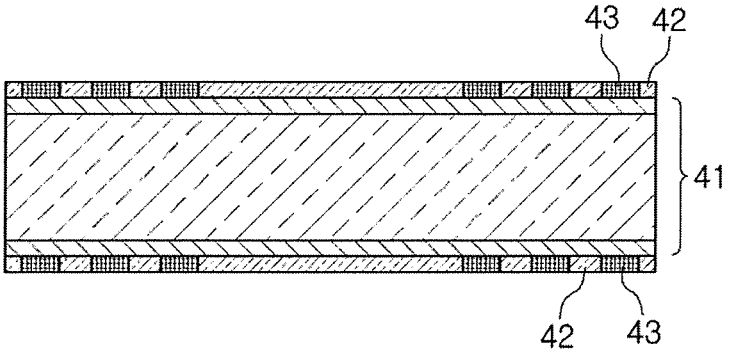
Figure 4E:
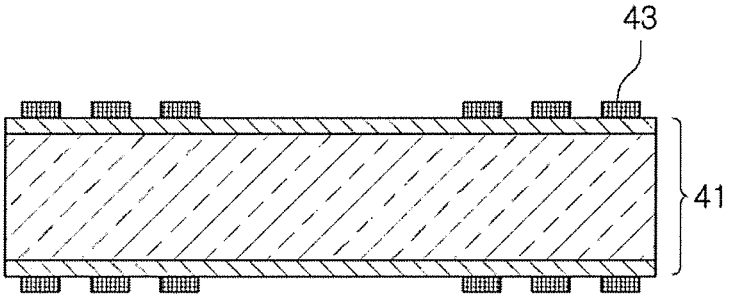
Figure 4F:
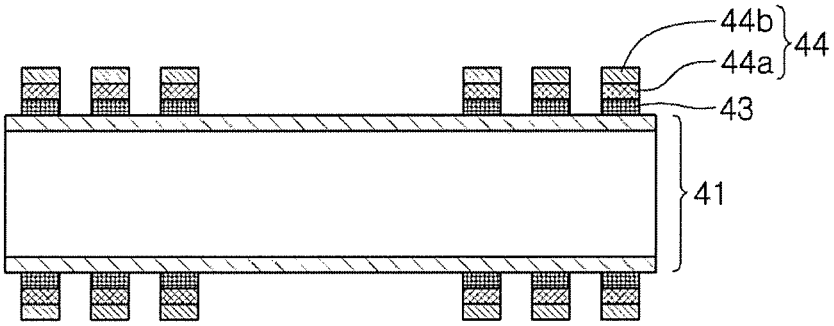
Figure 4G:
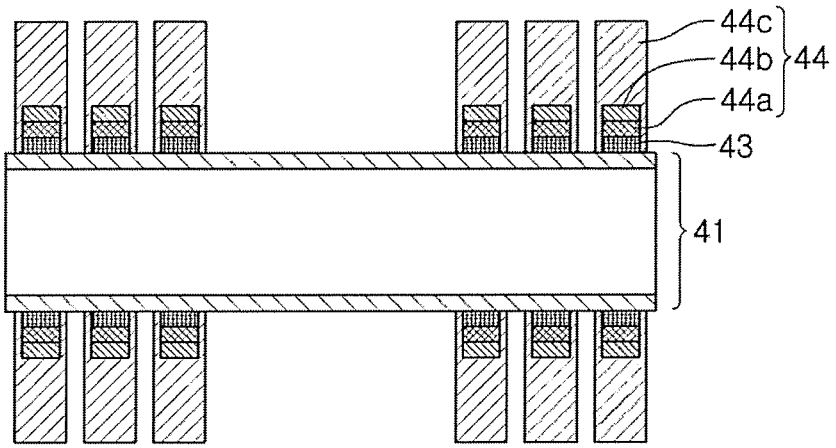
Figure 4H:
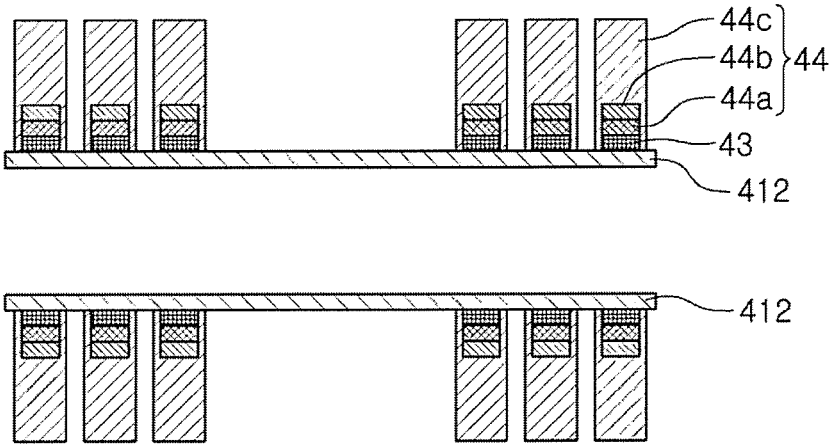
Figure 4I:
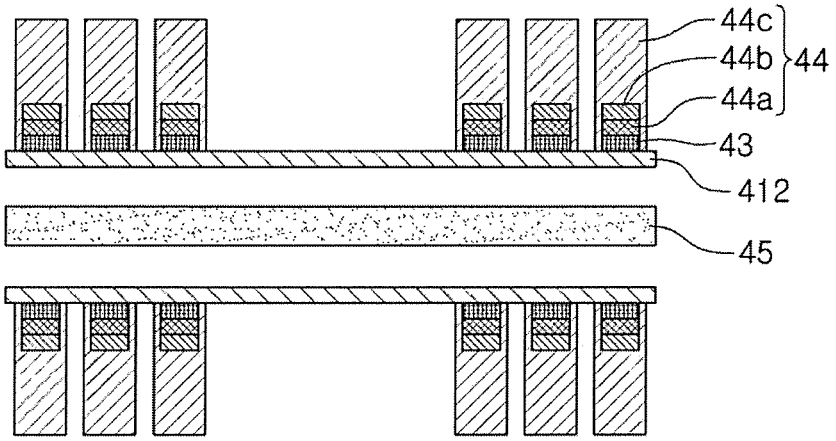
Figure 4J:
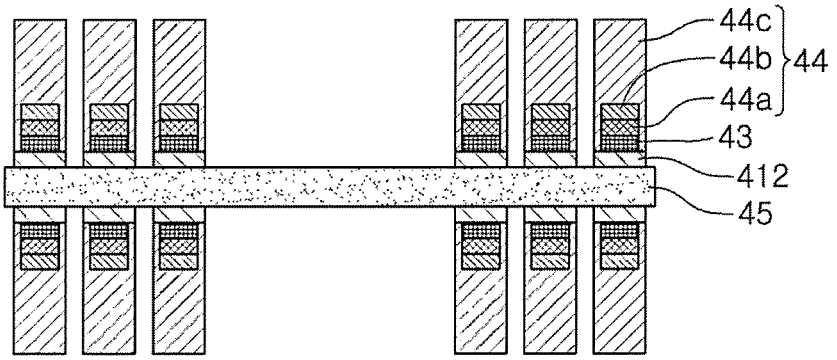
Figure 4K:
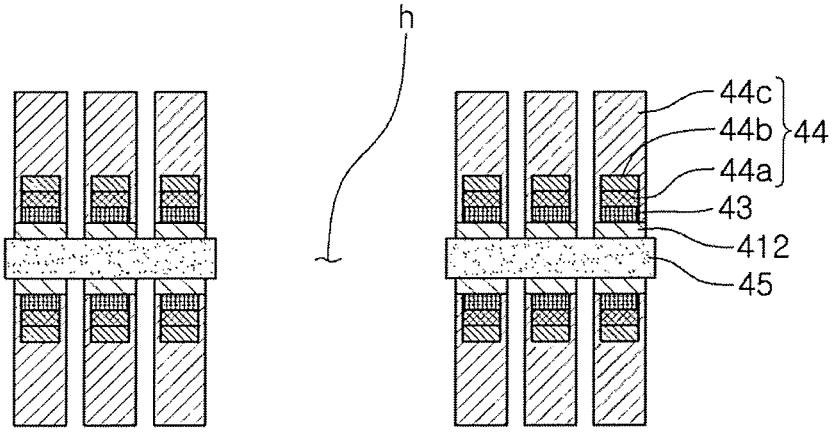
Figure 4L:
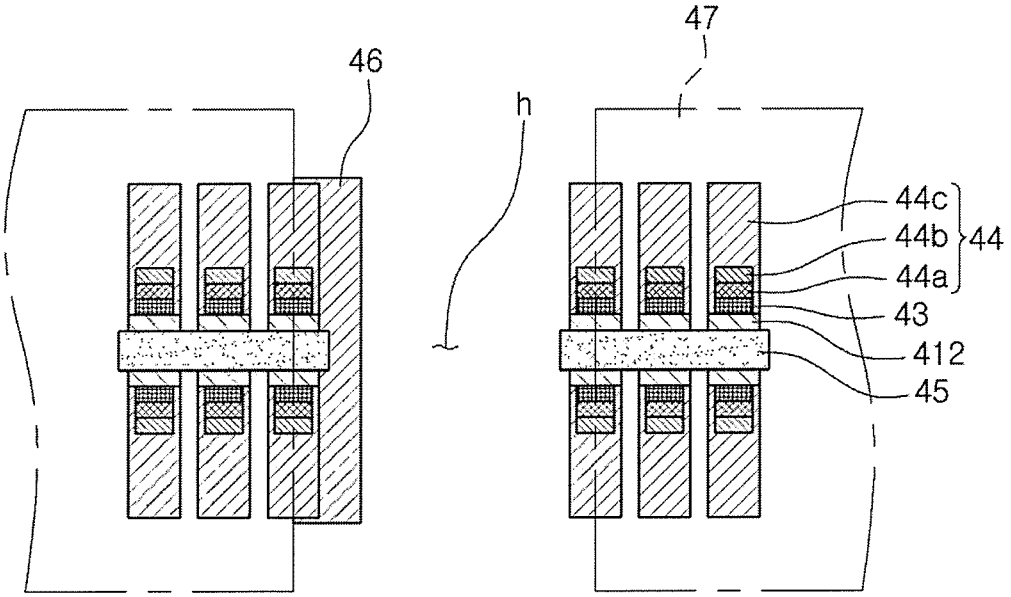
Figure 4M:
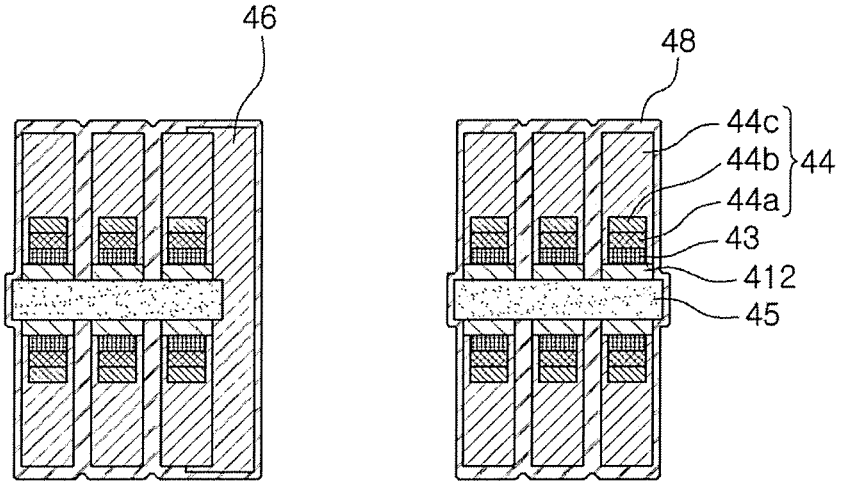
Figure 4N:
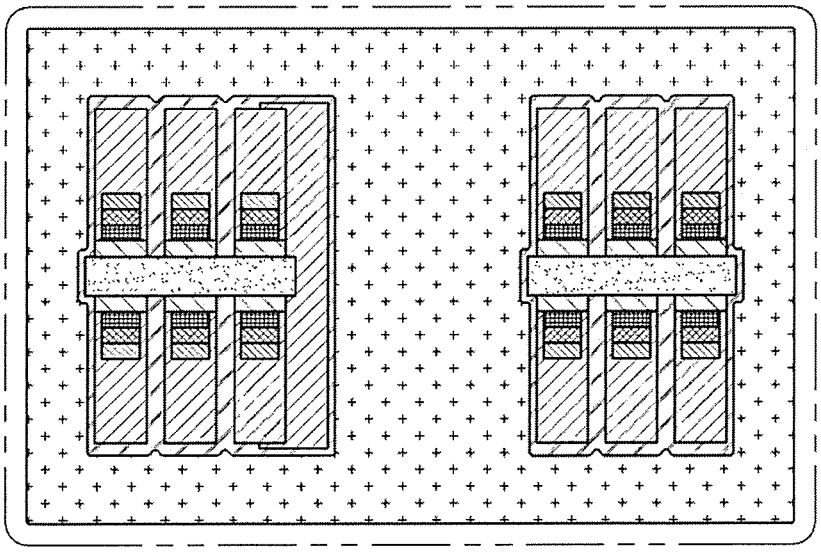

FIGS. 4A to 4N are detailed process diagrams illustrating a method of manufacturing the inductor 100. For convenience of explanation, each operation will be described using separate reference numerals and separate terms from those of FIGS. 1-3.

FIG. 4A illustrates an operation of preparing a substrate 41. In this case, a central portion of the substrate 41 may include an insulating substrate 411, and metal plating layers 412 may be disposed on upper and lower surfaces of the insulating substrate 411, respectively. The metal plating layers 412 may each have a thickness of approximately 20 μm, and may be configured by a combination of a carrier copper foil layer and a chemical copper plating layer. As the insulating substrate 411, any substrate having insulating properties may be used without limitation, and the metal plating layers 412 may be formed through chemical copper plating. A thickness of the entirety of the substrate 41 may be, in detail, about 60 μm, and in this case, an existing facility may be used as is, which may be advantageous in terms of the economical dimension. Although not illustrated in detail, the metal plating layer 412 may also be composed of a plurality of layers, and for example, may be configured to have a structure in which a carrier thin film layer and a seed thin film layer are combined. A thickness of each layer thereof may be appropriately selected, and for example, the carrier thin film layer may have a thickness of 18 μm, and the seed thin film layer may have a thickness of 2 μm, thereby providing the metal plating layer 412 having a thickness of a total of 20 μm.

FIG. 4B illustrates an operation of applying a dry film resist 42 to upper and lower surfaces of the substrate 41. The dry film resist 42 may be provided as a basis for patterning a coil shape through exposure and development.

FIG. 4C illustrates an operation of patterning the dry film resist 42 in a circuit shape. A detailed patterning scheme may be appropriately selected as required, and for example, exposure and development may be used.

FIG. 4D illustrates an operation of filling openings of the patterned dry film resist with a pattern layer 43. The pattern layer 43 may be formed by, for example, electroless plating, but a formation method thereof is not limited thereto.

FIG. 4E illustrates an operation of peeling the patterned dry film resist 42 to form the pattern layer 43. As a result, the pattern layer 43 formed in the operation of FIG. 4D and a conductor layer below the pattern layer 43 may remain.

FIG. 4F illustrates a secondary plating process 44 to increase the thickness of a coil. The secondary plating process may be selected from among isotropic plating and anisotropic plating as required, and the number of times the secondary plating process is performed may be appropriately selected as required, in consideration of required specifications. FIG. 4F illustrates the case in which anisotropic plating is performed twice (44*a* and 44*b*) for convenience of explanation, but an exemplary embodiment thereof is not limited thereto.

FIG. 4G illustrates an operation of further performing a plating process 44*c* to further increase the thickness of the coil. At this stage, the thickness of the overall coil may be secured. For example, aspect ratio (AR) may be 2.0 or more, and the thickness of the coil may be greater than 200 μm, but the thickness of the coil is not limited thereto. The pattern layer formed by the plating process 44C may embed side surfaces and an upper surface of a stacked structure including the pattern layer 43 and the pattern layers formed by the plating process 44.

FIG. 4H illustrates an operation of removing the substrate 41 from the coil, and may be referred to as a detaching process. The detaching process may be a preceding process to employ a thin film insulator to obtain a low profile inductor. For example, a thickness of the insulating substrate removed from the substrate may be twice a thickness of the support member included in an ultimately obtained inductor, or more, and the insulating substrate may also have a further increased thickness.

FIG. 4I illustrates an operation of disposing coils, separated from the substrate, on upper and lower surfaces of a support member 45, respectively.

FIG. 4J illustrates a process of separating adjacent coil patterns by etching a portion of the metal plating layer 412 disposed on a lower surface of the coil. In this process, short circuits between adjacent coil patterns may be prevented from occurring. A method of etching a portion of the metal plating layer 412 may be appropriately selected as required, and for example, chemical etching, laser etching or the like may be used without limitation.

FIG. 4K illustrates a cavity process in which a through-hole his formed. In this case, the through-hole h may be formed in a central portion of the support member using, for example, a $CO_2$ laser.

FIG. 4L illustrates an operation of forming a connection pattern 46 connecting the coils independently disposed on the upper and lower surfaces of the support member to each other. Since the connection pattern 46 is configured to electrically connect upper and lower coils to each other, the connection pattern 46 should include a material having relatively excellent electrical conductivity. On the other hand, a dry film 47 may be disposed, except for a portion for formation of the connection pattern 46, to prevent plating on portions other than the connection pattern. After the dry film 47 is disposed, an operation of selectively exposing only a portion of the coil for the formation of the connection pattern 46 may be performed using exposure and development, and other methods may also be used without limitation. Subsequently, by forming the connection pattern 46, the upper and lower coils may be electrically connected. The connection pattern 46 may have a thickness suitable to maintain rigidity to such an extent that the upper and lower coils may be connected. As long as the thickness of the connection pattern may satisfy the condition, the thickness of the connection pattern 46 may be controlled to be reduced in terms of miniaturization of a chip.

FIG. 4M illustrates an operation of removing the dry film 47 disposed with reference to FIG. 4L and of insulating a surface of an exposed coil. For example, a CVD process may be used to form an insulating layer 48. The insulating layer 48 may have a degree of thickness to appropriately perform an insulating function, for example, an average thickness within a range of 1 μm to 10 μm.

FIG. 4N illustrates a finishing process of filling a space including the upper and lower surfaces of the coil and a central portion of the through-hole, with a magnetic material, exposing a lead-out portion of the coil, and then, electrically connecting the lead-out portion of the coil to an external electrode.

According to the inductor described above, and the process of manufacturing the same described above, an inductor, in which a low profile may be provided and AR of a coil is increased, may be provided. Since a separate via hole forming process to connect the upper and lower coils is omitted, process efficiency may be increased. In addition, the related art problem in which a via is excessively plated may be prevented, and furthermore, not only plating deviation due to excessive plating of the via may be prevented, but also the efficiency of magnetic material filling space may be improved.

As set forth above, in effects according to an exemplary embodiment, in detail, as the thickness of a coil increases, Rdc characteristics may be increased within a predetermined size, and as the efficiency of a manufacturing process increases, economic effects in manufacturing an inductor may be improved.

While exemplary embodiments have been shown and described above, it will be apparent to those skilled in the art that modifications and variations could be made without departing from the scope of the present invention as defined by the appended claims.

What is claimed is:

1. An inductor comprising:

a body including a support member containing a through-hole, a coil disposed on the support member, and an encapsulant encapsulating the support member and the coil; and an external electrode disposed on an external surface of the body, wherein the coil includes an upper coil and a lower coil disposed on an upper surface and a lower surface of the support member, respectively, the upper coil and the lower coil being connected to each other by a connection pattern, the upper coil includes a first coil pattern, the first coil pattern having a lower surface facing the support member, an upper surface opposing the lower surface of the first coil pattern, and a side surface connecting the upper and lower surfaces of the first coil pattern to each other, and the lower coil includes a second coil pattern, the second coil pattern having an upper surface facing the support member, a lower surface opposing the upper surface of the second coil pattern, and a side surface connecting the upper and lower surfaces of the second coil pattern to each other, the connection pattern contacts a wall surface of the through-hole, the side surface of the first coil pattern, and the side surface of the second coil pattern, and the connection pattern includes a first portion covering a portion of the upper surface of the first coil pattern and a second portion covering a portion of the lower surface of the second coil pattern.

2. The inductor of claim 1, wherein the connection pattern extends along a portion of the wall surface of the through-hole, and the connection pattern and an innermost coil pattern of the coil form a right angle.

3. The inductor of claim 1, wherein the upper coil and the lower coil each comprise a plurality of pattern layers.

4. The inductor of claim 1, wherein another portion of the upper surface of the first coil pattern of the upper coil is exposed from the connection pattern, and another portion of the lower surface of the second coil pattern of the lower coil is exposed from the connection pattern.

5. The inductor of claim 1, wherein a thickness of the support member is within a range of 5 μm to 40 μm.

6. The inductor of claim 1, wherein the connection pattern comprises a conductive material.

7. The inductor of claim 1, wherein an outer boundary surface of the support member has a shape corresponding to a shape of an outer boundary surface of the coil.

8. The inductor of claim 1, wherein the through-hole is an only through-hole in the support member to penetrate through the upper surface and the lower surface of the support member.

9. The inductor of claim 1, further comprising an insulating layer extending continuously to cover the connection pattern and the coil.

10. The inductor of claim 9, wherein the insulating layer is in physical contact with the connection pattern.

11. The inductor of claim 1, wherein in a thickness direction along which the upper and lower surfaces of the support member oppose each other, a thickness of the connection pattern is greater than a thickness of the support member.

12. An inductor comprising:

a body including a support member containing a through-hole, a coil disposed on the support member, and an encapsulant encapsulating the support member and the coil; and an external electrode disposed on an external surface of the body, wherein the coil includes an upper coil and a lower coil disposed on an upper surface and a lower surface of the support member, respectively, the upper coil and the lower coil being connected to each other by a connection pattern disposed in the through-hole, the connection pattern surrounds at least portions of the upper coil and the lower coil and contacts a wall surface of the through-hole, and the connection pattern and the upper coil have a boundary therebetween, and the connection pattern and the lower coil have a boundary therebetween.

13. The inductor of claim 12, wherein the connection pattern extends along a portion of the wall surface of the through-hole, and the connection pattern and an innermost coil pattern of the coil form a right angle.

14. The inductor of claim 12, wherein the upper coil and the lower coil each comprise a plurality of pattern layers.

15. The inductor of claim 12, wherein a thickness of the support member is within a range of 5 μm to 40 μm.

16. The inductor of claim 12, wherein the connection pattern comprises a conductive material.

17. The inductor of claim 12, wherein an outer boundary surface of the support member has a shape corresponding to a shape of an outer boundary surface of the coil.

18. The inductor of claim 12, wherein the through-hole is an only through-hole in the support member to penetrate through the upper surface and the lower surface of the support member.

19. The inductor of claim 12, further comprising an insulating layer extending continuously to cover the connection pattern and the coil.

20. The inductor of claim 19, wherein the insulating layer is in physical contact with the connection pattern.

* * * * *